US010054016B2

(12) United States Patent
Watanabe et al.

(10) Patent No.: US 10,054,016 B2
(45) Date of Patent: Aug. 21, 2018

(54) FLEXIBLE-FUEL ENGINE

(71) Applicant: MAZDA MOTOR CORPORATION, Hiroshima (JP)

(72) Inventors: Tomomi Watanabe, Hiroshima (JP); Nobuyuki Furuichi, Hiroshima (JP); Sho Shimamoto, Hiroshima (JP); Mikinori Ohashi, Aki-gun (JP); Shigeyuki Hirashita, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 15/533,083

(22) PCT Filed: Jan. 14, 2016

(86) PCT No.: PCT/JP2016/050975
§ 371 (c)(1),
(2) Date: Jun. 5, 2017

(87) PCT Pub. No.: WO2016/117444
PCT Pub. Date: Jul. 28, 2016

(65) Prior Publication Data

US 2017/0335725 A1 Nov. 23, 2017

(30) Foreign Application Priority Data

Jan. 19, 2015 (JP) ..... 2015-007503

(51) Int. Cl.
*F02D 41/06* (2006.01)
*F01L 1/34* (2006.01)
(Continued)

(52) U.S. Cl.
CPC ..... *F01L 1/3442* (2013.01); *F02D 19/084* (2013.01); *F02D 41/064* (2013.01); *F02D 41/065* (2013.01)

(58) Field of Classification Search
CPC ..... F02D 13/0207; F02D 13/0219; F02D 19/084; F02D 41/064; F02D 41/065;
(Continued)

(56) References Cited

U.S. PATENT DOCUMENTS

2008/0092834 A1 4/2008 Stein et al.
2012/0004826 A1* 1/2012 Shimo ..... F02D 41/3035 701/103
(Continued)

FOREIGN PATENT DOCUMENTS

JP 2008-106766 A 5/2008
JP 2011-064109 A 3/2011
WO 2012/049751 A1 4/2012

OTHER PUBLICATIONS

International Search Report issued in PCT/JP2016/050975; dated Mar. 8, 2016.

*Primary Examiner* — John Kwon
*Assistant Examiner* — Johnny H Hoang
(74) *Attorney, Agent, or Firm* — Studebaker & Brackett PC

(57) ABSTRACT

In a flexible-fuel engine capable of using fuel containing alcohol as fuel to be combusted in a cylinder, the geometric compression ratio is set to 12 or more, the engine is started by using fuel containing alcohol, an intake valve closing timing at an engine start time is set to an advance angle side than a first reference timing being a timing corresponding to a most retarded angle position out of intake valve closing timings capable of starting the engine in combusting fuel of alcohol 100% in the cylinder at a first intake temperature, and is set to a timing on a retarded angle side than a second reference timing being a timing corresponding to a most advanced angle position out of intake valve closing timings capable of avoiding pre-ignition in combusting fuel of
(Continued)

gasoline 100% at an engine start time at a second intake temperature.

7 Claims, 6 Drawing Sheets

(51) Int. Cl.
*F02D 19/08* (2006.01)
*F01L 1/344* (2006.01)

(58) Field of Classification Search
CPC ..... F02D 41/3035; F02D 41/402; F02B 3/00; F02B 5/00; F02B 1/12; F02B 29/0418; F02B 2275/15; F01L 1/34; F01L 1/3442
USPC ..... 701/102–105, 110–115; 123/179.3, 123/179.5, 179.13, 179.15, 294–299, 301, 123/305, 525, 575, 1 A
See application file for complete search history.

(56) References Cited

U.S. PATENT DOCUMENTS

2012/0318218 A1* 12/2012 Kato ..... F01L 1/3442 123/90.12
2013/0192209 A1 8/2013 Tsukagoshi et al.
2017/0211499 A1* 7/2017 Ochi ..... F02D 13/0219

* cited by examiner

FLEXIBLE-FUEL ENGINE

TECHNICAL FIELD

The present invention relates to a flexible-fuel engine capable of using fuel containing alcohol.

BACKGROUND ART

There is known a flexible fuel vehicle (FFV) loaded with a flexible-fuel engine capable of using fuel containing alcohol such as ethanol as a regeneratable resource in order to reduce petroleum consumption or the like.

As the alcohol-based fuel, there are known fuel (referred to as E100) containing 100% ethanol (more specifically, hydrous ethanol containing 5% water), and mixed fuel (referred to as E22) containing 22% ethanol and 78% gasoline. In some of the districts (such as countries), gasoline i.e. fuel (referred to as E0) which does not contain alcohol may be used in addition to the aforementioned alcohol-based fuels, as fuel for flexible fuel vehicles. Specifically, various fuels in which the alcohol content is arbitrarily set in the range of from 0 to 100% may be used in combination as vehicular fuels.

However, ethanol has a low vaporability and a low ignitability, and gasoline has a high ignitability. Thus, ignitability of fuel greatly differs depending on a difference in alcohol content. Consequently, various inconveniences may occur when these fuels are used in combination.

For instance, Patent Literature 1 discloses an inconvenience that occurrence of knocking is different depending on fuel to be used. In order to solve the aforementioned inconvenience, Patent Literature 1 discloses a configuration, in which the type of fuel in a fuel tank is detected by a fuel sensor, and an intake valve closing timing is changed according to the detection result.

Further, there is known an inconvenience that it is difficult to secure startability accompanied by a difference in ignitability as described above. Conventionally, in order to solve the aforementioned inconvenience, an auxiliary fuel tank for securing startability is provided independently of a normal fuel tank, and fuel having a low ethanol content and a high ignitability is introduced to the auxiliary fuel tank. At an engine start time, the engine is started by using the fuel in the auxiliary fuel tank, and during a normal operation thereafter, the fuel in the normal fuel tank is used.

CITATION LIST

Patent Literature

Patent Literature 1: Japanese Unexamined Patent Publication No. 2008-106766

SUMMARY OF INVENTION

However, when an auxiliary fuel tank is provided independently of a normal fuel tank as described above, the cost may increase, and a system may be complicated because two fuel supply systems are used.

In view of the above, an object of the present invention is to provide a flexible-fuel engine that enables to secure startability without depending on the alcohol content of fuel to be used with a simplified configuration.

Solution to Problem

As a result of intensive research on the aforementioned inconveniences, the inventors of the present application found that it is possible to start an engine in a satisfactory manner by setting a geometric compression ratio of a cylinder to 12 or more, and by causing the engine to perform appropriate combustion in the cylinder at an engine start time, even when fuel having a low ignitability and containing 100% alcohol is used. However, when fuel having a low alcohol content and a high ignitability is used, simply increasing the geometric compression ratio of a cylinder may cause pre-ignition i.e. a phenomenon that a fuel-air mixture starts combustion before fuel is ignited by an ignition device, and noise or the like may increase. Regarding this point, the inventors of the present application found, as a result of further research, that it is possible to avoid pre-ignition even when fuel having a low alcohol content is used by setting a geometric compression ratio of a cylinder to 12 or more, and by setting an intake valve closing timing at an engine start time in a specific range.

The invention of the present application is made on the basis of the aforementioned finding. The present invention provides a flexible-fuel engine that enables to use fuel containing alcohol as fuel to be combusted in a cylinder. The flexible-fuel engine includes a fuel injection device which directly injects fuel into the cylinder; and an ignition device which ignites a fuel-air mixture in the cylinder. A geometric compression ratio of the cylinder is set to 12 or more. The engine is started by using the fuel containing alcohol at an engine start time. An intake valve closing timing at the engine start time is set to a retarded angle side than an intake bottom dead center, is set to an advanced angle side than a predetermined first reference timing, and is set to the retarded angle side than a second reference timing. The first reference timing is set to a timing corresponding to a most retarded angle position out of intake valve closing timings capable of starting the engine in combusting fuel of 100% alcohol in the cylinder at a predetermined first intake temperature. The second reference timing is set to a timing corresponding to a most advanced angle position out of intake valve closing timings capable of avoiding pre-ignition in combusting fuel of 100% gasoline in the cylinder at an engine start time at a second intake temperature higher than the first intake temperature.

According to the present invention, it is possible to secure startability without depending on the alcohol content of fuel to be used with a simplified configuration.

DESCRIPTION OF EMBODIMENTS

Figure 1:
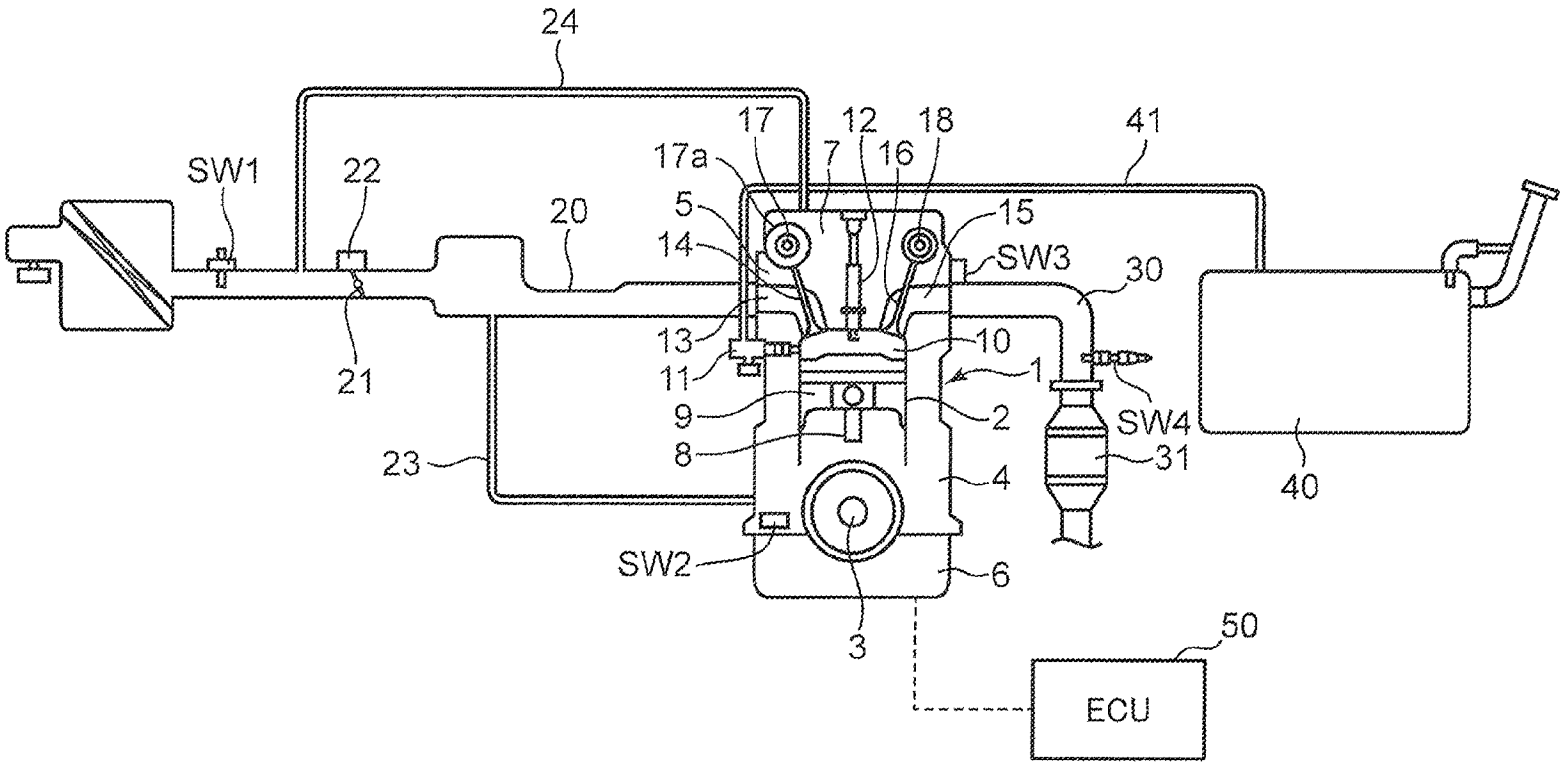
FIG. 1 is an overall configuration diagram of an engine according to an embodiment of the present invention.

In the following, a flexible-fuel engine according to an embodiment of the present invention is described referring to the drawings.

(1) Overall Configuration

As illustrated in FIG. 1, an engine 1 according to the embodiment is a spark-ignition 4-cycle engine including a plurality of cylinders 2 (in FIG. 1, only one cylinder is illustrated). The engine 1 includes a cylinder block 4 which rotatably supports a crankshaft 3, a cylinder head 5 disposed above the cylinder block 4, an oil pan 6 disposed below the cylinder block 4, and a head cover 7 disposed above the cylinder head 5.

A piston 9 connected to the crankshaft 3 via a connecting rod 8 is slidably accommodated in each cylinder 2. A combustion chamber 10 is formed above the piston 9. An injector (a fuel injection device) 11 which directly injects fuel into the combustion chamber 10 is provided in the cylinder head 5. An ignition plug (an ignition device) 12 for igniting a fuel-air mixture in the combustion chamber 10 is provided at a ceiling wall portion of the combustion chamber 10. Fuel in a fuel tank 40 is supplied to the injector 11 via a fuel supply pipe 41. The injector 11 directly injects the fuel into the combustion chamber 10. In the embodiment, a pressure of fuel to be supplied to the injector 11 is set to a relatively high pressure such as about 40 to 120 MPa in order to promote atomization of fuel. Further, fuel is controlled to be directly injected into the combustion chamber 10 during a compression stroke.

Further, intake valves 14 for opening and closing intake ports 13, and exhaust valves 16 for opening and closing exhaust ports 15 are provided in the cylinder head 5.

Each intake valve 14 and each exhaust valve 16 are respectively driven to be opened and closed by an intake valve mechanism 17 and an exhaust valve mechanism 18. The intake valve mechanism 17 and the exhaust valve mechanism 18 respectively include an intake camshaft (not illustrated) and an exhaust camshaft (not illustrated) to be connected to the crankshaft 3 via a well-known chain/sprocket mechanism or the like. The intake valve mechanism 17 and the exhaust valve mechanism 18 respectively open and close the intake valve 14 and the exhaust valve 16 in association with the crankshaft 3.

The intake valve mechanism 17 includes an intake valve timing variable mechanism (an intake valve opening and closing timing changing device) 17*a* for changing an opening and closing timing of the intake valve 14. The intake valve timing variable mechanism 17*a* changes an opening and closing timing of the intake valve 14 by changing a phase of the intake camshaft with respect to the crankshaft 3. In the embodiment, the intake valve timing variable mechanism 17*a* is hydraulically operated, and changes an opening and closing timing of the intake valve 14 according to a supplied hydraulic pressure. Specifically, an oil pump (not illustrated) to be driven by the crankshaft 3 is provided in a vehicle. The intake valve timing variable mechanism 17*a* is driven by receiving pressurized hydraulic oil supplied from the oil pump, and changes an opening and closing timing of the intake valve 14. Further, in the embodiment, the intake valve timing variable mechanism 17*a* changes an opening and closing timing of the intake valve 14 while keeping the valve opening period of the intake valve 14 unchanged.

A locking mechanism for fixing an opening and closing timing of the intake valve 14 to a predetermined timing is provided in the intake valve timing variable mechanism 17*a*. The locking mechanism locks the phase of the intake camshaft with respect to the crankshaft 3 at a predetermined position to fix the opening and closing timing of the intake valve 14 to a predetermined timing, regardless of a hydraulic pressure. An example of the locking mechanism includes a locking pin which connects a rotary member integrally rotated with a crankshaft, and an intake camshaft in such a manner that the rotary member and the intake camshaft are non-rotatable relative to each other. The phase of the intake camshaft is fixed by the locking pin.

An intake passage 20 is connected to the intake port 13, and an exhaust passage 30 is connected to the exhaust port 15. A throttle valve 21 for adjusting an amount of intake air is provided in the intake passage 20. A catalyst device 31 for accommodating an unillustrated three-way catalyst for purifying exhaust gas is provided in the exhaust passage 30.

A PCV (Positive Crankcase Ventilation) hose 23 for refluxing, to the intake passage 20, an unburned fuel-air mixture (blow-by gas) leaking from the combustion chamber 10 to a crankcase is provided between the crankcase serving as a space from a lower portion of the cylinder block 4 to an upper portion of the oil pan 6, and a downstream portion of the intake passage 20 with respect to the throttle valve 21. A ventilation hose 24 for ventilation is provided between the head cover 7, and an upstream portion of the intake passage 20 with respect to the throttle valve 21.

Further, a starter motor (not illustrated) for causing the engine 1 to perform a cranking operation at an engine start time is provided in the engine 1.

The aforementioned devices are integrally controlled by an engine control unit (ECU) 50 illustrated in FIG. 1. As is well-known, the ECU 50 is a microprocessor constituted by a CPU, an ROM, an RAM, and the like. For instance, the ECU 50 controls a hydraulic pressure (the oil pump) to be supplied to the intake valve timing variable mechanism 17*a* so as to change an opening and closing timing of the intake valve 14 to an appropriate timing according to an operating condition of the engine 1.

(2) Setting of Geometric Compression Ratio and Intake Valve Closing Timing at Engine Start Time The engine 1 having the aforementioned configuration is a flexible-fuel engine capable of using fuel containing ethanol (alcohol), and fuel of 100%/o gasoline. The engine 1 is mounted in a flexible fuel vehicle (FFV). Therefore, ethanol-containing fuel such as E100 (fuel containing 100% ethanol (hydrous ethanol containing 5% water)) or E22 (mixed fuel containing 22% ethanol and 78% gasoline), and E0 (fuel of 100% gasoline) are supplied to the fuel tank 40. Specifically, fuel in which the ethanol content (the alcohol content) is set to an arbitrary value in the range of from 0 to 100% is supplied to the fuel tank 40. Various fuels whose ethanol contents are different from each other are supplied to the combustion chamber 10.

Ethanol is a single component fuel without containing a low boiling component. Therefore, ethanol has a low vaporability and a low ignitability, as compared with gasoline. In particular, E100 containing a moisture content, in which the moisture content is not sufficiently removed in an ethanol purification process, has a low vaporability. Further, vaporability of ethanol is drastically lowered when ethanol is in a low-temperature condition. In view of the above, when fuel having a high ethanol content such as E100 is used, securing startability, particularly, securing startability when the engine is cold started is an important task.

On the other hand, increasing the geometric compression ratio of a cylinder makes it possible to increase a compression end temperature for promoting vaporization of fuel, and to enhance startability. However, simply increasing the geometric compression ratio may cause pre-ignition i.e. a phenomenon that a fuel-air mixture is combusted before the fuel is ignited by the ignition plug 12, and may increase the noise when fuel without containing ethanol such as E0, or fuel having a low ethanol content and having a high ignitability is used.

Figure 2:
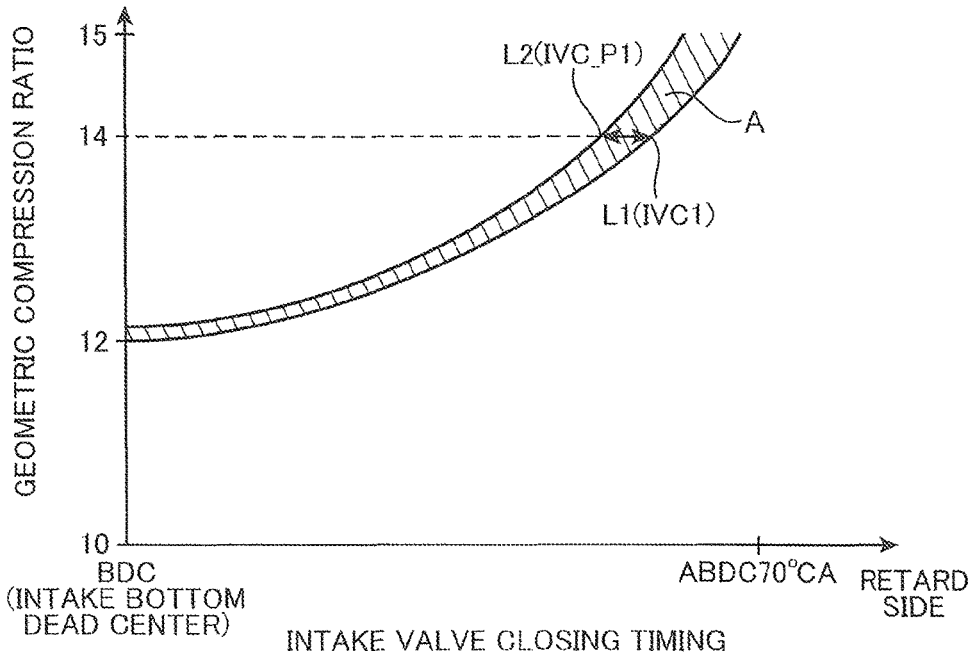
FIG. 2 is a graph illustrating an appropriate area.

As a result of intensive research, the inventors of the present application found that it is possible to secure startability and to avoid pre-ignition without depending on an ethanol content by setting a geometric compression ratio and an intake valve closing timing at an engine start time to a value in an appropriate area A illustrated in FIG. 2. Specifically, the inventors of the present application found that there exists an area relating to a geometric compression ratio and an intake valve closing timing at an engine start time that enables to satisfy both of the aforementioned conditions.

In the embodiment, a geometric compression ratio and an intake valve closing timing at an engine start time are set to a predetermined compression ratio and to a predetermined timing (an appropriate timing) included in the appropriate area A on the basis of the aforementioned finding.

As illustrated in FIG. 2, the appropriate area A is an area, in which the geometric compression ratio is 12 or more, and the intake valve closing timing is close to the retarded angle side than the intake bottom dead center, and an area, in which the intake valve closing timing is close to the advanced angle side than a first line (a first reference timing) L1 and is close to the retarded angle side than a second line (a second reference timing) L2.

Figure 3:
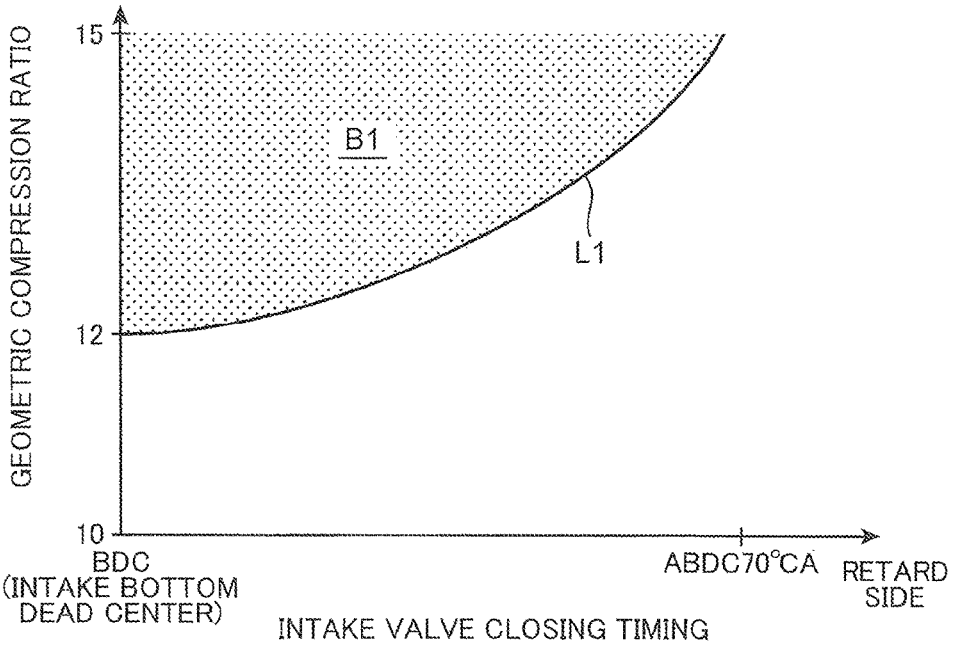
FIG. 3 is a graph illustrating an area capable of securing cold startability of E100.

The first line L1 is a line connecting intake valve closing timings corresponding to most retarded angle positions regarding respective values of the geometric compression ratio in an area B1 illustrated in FIG. 3. The area B1 is an area capable of securing startability in starting the engine 1 when the intake temperature is equal to a predetermined first intake temperature in using E100 having a lowest vaporability as described above. In the embodiment, the area B1 is an area relating to a time when the engine is cold started. The time when the engine is cold started is such that after the engine 1 is placed in a condition that the engine water temperature and the ambient temperature are −5° C., the engine 1 is started in a state that the temperature of the engine 1 is stabilized at a predetermined temperature i.e. a state that the intake temperature (a temperature of air to be drawn into each cylinder) is substantially equal to the ambient temperature of about −5° C.

Figure 4:
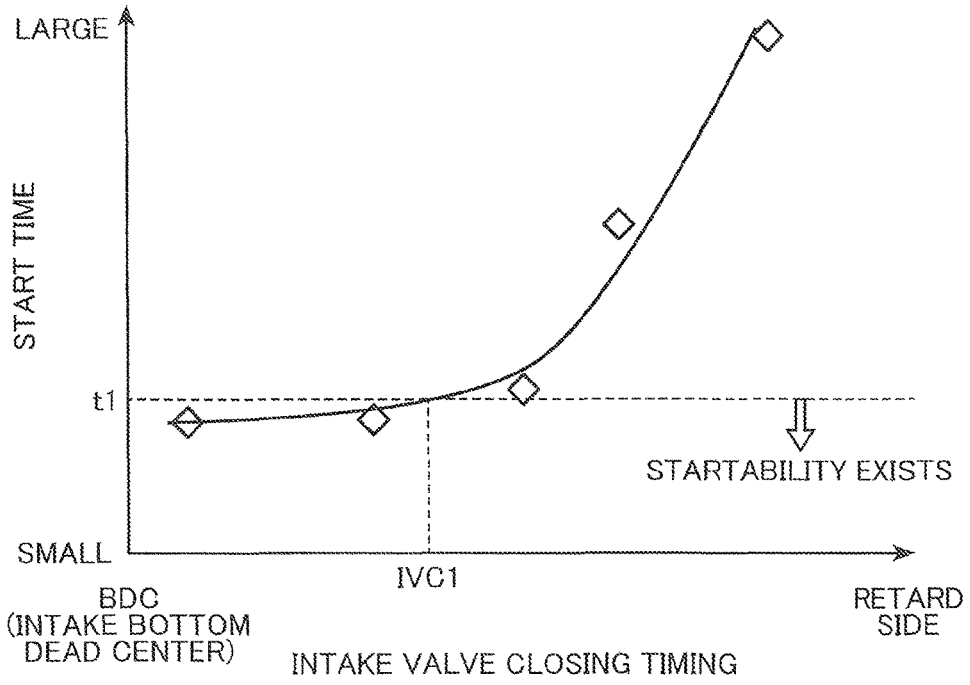
FIG. 4 is a graph illustrating a relationship between an intake valve closing timing and an engine start time.

The aforementioned matter is described in detail using FIG. 4. FIG. 4 is a diagram, in which a change in the engine start time with respect to a change in the intake valve closing timing is examined when the engine whose geometric compression ratio is set to a predetermined value is cold started. The engine start time is a time from a point of time when the starter motor is turned on until the engine speed is increased to a predetermined value. As illustrated in FIG. 4, when the geometric compression ratio is constant, the engine start time increases as the intake valve closing timing is closer to the retarded angle side, and startability is deteriorated. Note that this tendency is not changed even if the value of a geometric compression ratio is changed. Further, in the embodiment, it is determined that startability is secured as far as the engine start time is equal to or shorter than a predetermined time t1. Therefore, the area B1 is an area, in which the intake valve closing timing is on the advanced angle side than a timing IVC1 at which the engine start time is equal to the predetermined time t1, and the intake valve closing timing IVC1 is a point on the first line L1. Specifically, the inventors of the present application set the geometric compression ratio to various values, and examined a relationship between an intake valve closing timing and an engine start time regarding each value of the geometric compression ratio. Further, the inventors extracted an intake valve closing timing at which the engine start time is equal to the predetermined time t1 regarding each value of the geometric compression ratio, and determined the first line L1 by connecting the intake valve closing timings.

As illustrated in FIG. 3, the first line L1 is a line indicating that as the geometric compression ratio is increased, the intake valve closing timing is closer to the retarded angle side. This is because as the geometric compression ratio is increased, the compression end temperature is increased. This makes it possible to implement appropriate ignition i.e. to secure startability by keeping the compression end temperature high even if an intake valve is closed at a relatively retarded timing. Further, the first line L1 exists in an area in which the geometric compression ratio is 12 or more.

Figure 5:
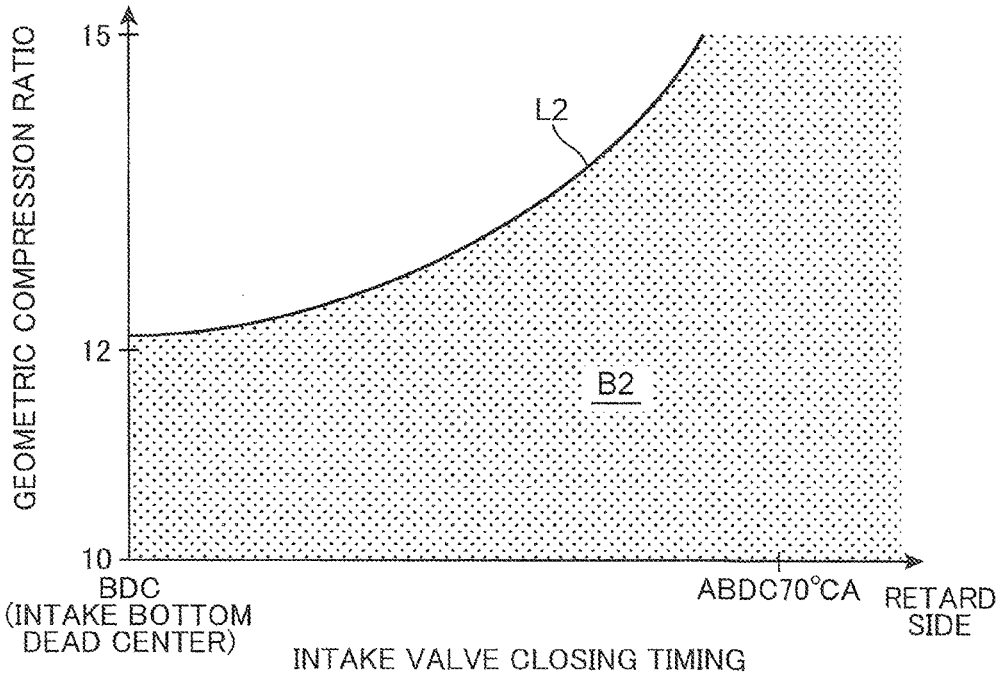
FIG. 5 is a graph illustrating an area capable of avoiding pre-ignition of E0 when the engine is hot started.

On the other hand, the second line L2 is a line connecting intake valve closing timings corresponding to most advanced angle positions regarding respective values of a geometric compression ratio in an area B2 illustrated in FIG. 5. The area B2 is an area, in which pre-ignition does not occur at an engine start time and during a low-load operation time following the engine start time such as an idling operation time, when E0 having a highest ignitability i.e. fuel of 100% gasoline is used, and when the intake temperature is equal to a second intake temperature higher than the first intake temperature. In the embodiment, the area B2 is set to an area, in which pre-ignition does not occur when the engine is hot started, for instance, when the engine is started in a state that the engine cooling water temperature is about 100° C., and the intake temperature is a temperature (e.g. about 20° C.) at least higher than the intake temperature when the engine is cold started i.e. −5° C.

Figure 6:
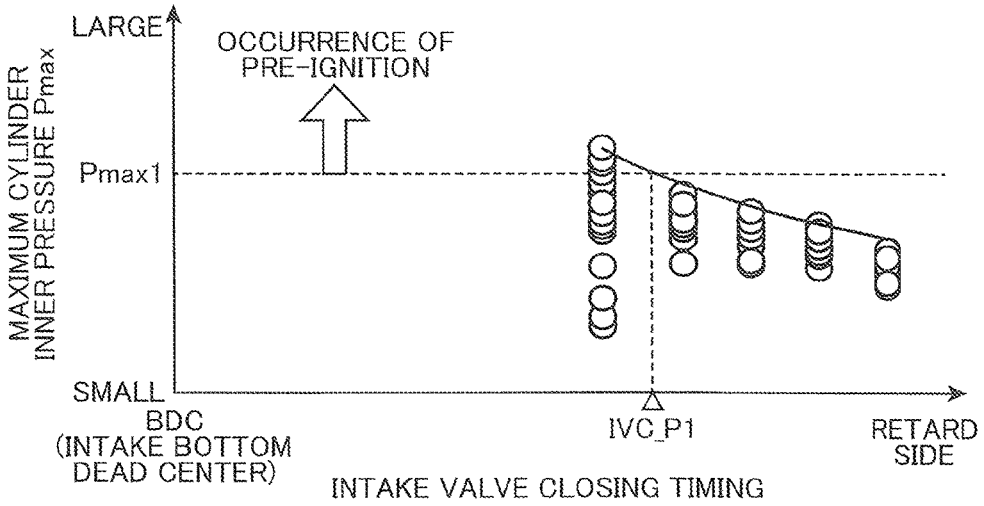
FIG. 6 is a graph illustrating a relationship between an intake valve closing timing and a maximum cylinder inner pressure.

The aforementioned matter is described in detail using FIG. 6. FIG. 6 is a diagram, in which a change in a maximum value (a maximum cylinder inner pressure) Pmax of a cylinder inner pressure at an engine start time with respect to a change in the intake valve closing timing is examined when the engine whose geometric compression ratio is set to a predetermined value is hot started. As illustrated in FIG. 6, when the geometric compression ratio is constant, the maximum cylinder inner pressure Pmax is increased, as the intake valve closing timing is closer to the advanced angle side. Further, pre-ignition occurs when the maximum cylinder inner pressure Pmax is equal to or larger than a predetermined value Pmax1. Therefore, the area B2 is an area, in which the intake valve closing timing is on the retarded angle side than an intake valve closing timing IVC_P1 at which the maximum cylinder inner pressure Pmax is equal to the predetermined value Pmax1, and the intake valve closing timing IVC_P1 is a point on the second line L2. Specifically, the inventors of the present application changed the geometric compression ratio to various values, and examined a relationship between an intake valve closing timing and the maximum cylinder inner pressure Pmax regarding each value of the geometric compression ratio. Further, the inventors extracted an intake valve closing timing at which the maximum cylinder inner pressure Pmax is equal to the predetermined value Pmax1 regarding each value of the geometric compression ratio, and determined the second line L1 by connecting the intake valve closing timings.

As described above, in the embodiment, the appropriate area A is set in an area surrounded by the lines L1 and L2. The appropriate area A is an area, in which it is possible to secure startability even when the engine is cold started in using E100, and in which it is possible to avoid pre-ignition even when the engine is hot started in using E0.

As described above, in the engine 1 according to the present invention, the geometric compression ratio is 12 or more, and the geometric compression ratio and the intake valve closing timing at an engine start time are set to a compression ratio and a timing included in the appropriate area A. For instance, the geometric compression ratio is set to about 14, and the intake valve closing timing at an engine start time is set to about 50 to 60° CA ABDC (after intake bottom dead center).

As described above, in the embodiment, the intake valve timing variable mechanism 17*a* for changing the intake valve closing timing is hydraulically operated. Therefore, when a hydraulic pressure is not secured at an engine start time, it may be impossible to change the intake valve closing timing to the aforementioned appropriate timing. Specifically, an oil pump for supplying hydraulic oil is configured to be driven by an engine. Therefore, at an engine start time when the engine speed is low, it may be difficult to supply, to the intake valve timing variable mechanism 17*a*, a hydraulic pressure sufficient for changing the closing timing of the intake valve 14 to an appropriate timing.

In view of the above, in the embodiment, an intake valve closing timing is changed to the aforementioned appropriate timing, and is fixed (locked) before the engine is started. Specifically, when the engine is stopped (e.g. when the engine speed is equal to or lower than a predetermined value), the intake valve closing timing is changed to an appropriate timing by the intake valve timing variable mechanism 17*a*, and is locked to the appropriate timing. In the embodiment, the appropriate timing is set to a timing corresponding to a most retarded angle position out of intake valve closing timings changeable by the intake valve timing variable mechanism 17*a*. Therefore, the intake valve timing variable mechanism 17*a* (a locking mechanism) changes the intake valve closing timing to a timing corresponding to a most retarded angle position, and locks the intake valve closing timing when the engine is stopped. Note that when a hydraulic pressure to be supplied to the intake valve timing variable mechanism 17*a* is secured after the engine is started, the intake valve timing variable mechanism 17*a* advances the intake valve opening and closing timing as necessary according to an operating condition to perform appropriate combustion in the cylinder.

Further, the inventors of the present application obtained a finding that it is preferable to set a difference between a valve opening start timing of the intake valve 14 and a valve closing timing of the exhaust valve 16 at an engine start time in the range of from −5° CA to 5° CA, specifically, to set an overlap period when a valve opening period of the intake valve 14 and a valve opening period of the exhaust valve 16 overlap in the range of from −5° CA to 5° CA in order to secure an amount of air (an intake amount) to be introduced to a cylinder at an engine start time and during an idling operation time following the engine start time, and to secure combustion stability and engine output when the intake valve closing timing at an engine start time is set to the aforementioned appropriate timing. In view of the above, in the embodiment, the valve opening start timing of the intake valve 14 at an engine start time is set in such a manner as to satisfy the aforementioned condition i.e. a condition that the overlap period is in the range of from −5° CA to 5° CA. As described above, in the embodiment, the intake valve timing variable mechanism 17*a* changes the valve opening and closing timing while keeping the valve opening period of the intake valve 14 unchanged. Therefore, setting the valve opening start timing of the intake valve 14 at an engine start time as described above, and setting the valve closing timing of the intake valve 14 at an engine start time as described above makes it possible to set the valve opening period of the intake valve 14 to a predetermined period. Note that the overlap period has a minus value means that the valve opening period of the intake valve 14 and the valve opening period of an exhaust valve do not overlap each other. A minus period indicates a period from a valve closing timing of the exhaust valve 16 to a valve opening timing of an intake valve.

As described above, in the flexible-fuel engine according to the embodiment, the geometric compression ratio is set to 12 or more, and the geometric compression ratio and the intake valve closing timing at an engine start time are set to a value in the appropriate area A, in which it is possible to secure startability even when the engine is started in using E100 at an engine start time when the intake temperature is set to the relatively low first intake temperature, and in which it is possible to avoid pre-ignition even when the engine is started in using E0 at an engine start time when the intake temperature is set to the relatively high second intake temperature. E100 is fuel having a lowest ignitability out of E0 to E100, which may be used for the engine. Therefore, as far as startability is securable in using E100 in a condition that the intake temperature is low and it is difficult to secure startability as described above, it is possible to secure startability even in using the other fuels. Further, E0 is fuel having a highest ignitability out of the aforementioned fuels, and is fuel in which pre-ignition is likely to occur. Therefore, as far as pre-ignition is avoidable in using E0 in which the intake temperature is high and pre-ignition is likely to occur as described above, it is possible to avoid pre-ignition even in using the other fuels.

Therefore, by setting a geometric compression ratio and an intake valve closing timing at an engine start time as described above, the flexible-fuel engine according to the embodiment can appropriately start the engine without pre-ignition in using E0 to E100 i.e. all the fuels in which the ethanol content is set to an arbitrary value in the range of from 0 to 100%. Further, using the embodiment makes it possible to simplify the configuration, and to reduce the cost without the need of providing an auxiliary fuel tank independently of a normal fuel tank in order to supply fuel having a high startability to the engine at an engine start time, and without the need of providing two fuel supply systems.

In particular, in the embodiment, the first line L1 is set to a line capable of appropriately starting the engine in using E100 even in a cold start state i.e. in a condition that it is difficult to start the engine. Therefore, setting a geometric compression ratio and an intake valve closing timing at an engine start time to a value in the appropriate area A makes it possible to securely secure startability in using all types of the fuels even when the engine is hot started, specifically, no matter when the engine is cold started or hot started.

Further, in the embodiment, the second line L2 is set to a line capable of avoiding pre-ignition at an engine start time in using E0 even when the engine is hot started i.e. in a condition that pre-ignition is likely to occur. Therefore, it is possible to securely avoid pre-ignition in using all types of the fuels no matter when the engine is hot started or cold started.

Further, in the embodiment, an intake valve closing timing is locked to the aforementioned appropriate timing by the locking mechanism of the intake valve timing variable mechanism 17*a* before the engine is started. Therefore, it is possible to securely set an intake valve closing timing to the aforementioned appropriate timing at an engine start time, and to appropriately start the engine while avoiding pre-ignition.

(3) Modifications

In the aforementioned embodiment, there is described a case, in which the first line L1 is set to a line capable of appropriately starting the engine in using E100 when the engine is cold started. Alternatively, the first line L1 may be set when the engine is hot started, or may be set to a line in which the intake temperature is higher than the aforementioned −5° C. When the present invention is configured as described in the embodiment, however, it is possible to secure startability no matter when the engine is cold started or hot started. Further, in the embodiment, there is described a case, in which a time when the engine is started in a condition that the ambient temperature (the intake temperature) is −5° C. is a time when the engine is cold started. The definition about the time when the engine is cold started is not limited to the above. A time when the engine is started at an engine water temperature of not higher than a predetermined temperature may be defined as the time when the engine is cold started. Further, for instance, a time when the engine is started in a low-temperature condition as the ambient temperature in a district where the flexible fuel vehicle according to the embodiment is used may be defined as the time when the engine is cold started.

Further, in the embodiment, there is described a case, in which a time when the engine is started at an engine water temperature of about 100° C. is a time when the engine is hot started. The definition about the time when the engine is hot started is not limited to the above. A time when the engine is started at another engine water temperature or higher may be defined as the time when the engine is hot started. Further, the second intake temperature is not limited to an intake temperature at a time when the engine is cold started, but may be a temperature higher than the first intake temperature.

Further, in the embodiment, there is described a case, in which the intake valve timing variable mechanism 17*a* is hydraulically operated. Alternatively, the intake valve timing variable mechanism 17*a* may be electrically operated or the like. However, as described above, when the intake valve timing variable mechanism 17*a* is hydraulically operated, it may be impossible to appropriately change the intake valve closing timing by the intake valve timing variable mechanism 17*a* immediately after the engine is started. In view of the above, in this case, it is preferable to lock an intake valve closing timing to the aforementioned appropriate timing when the engine is stopped by the locking mechanism included in the intake valve timing variable mechanism 17*a*.

The following is a summary of the present invention as described above.

The invention of the present application is directed to a flexible-fuel engine capable of using fuel containing alcohol as fuel to be combusted in a cylinder. The flexible-fuel engine includes a fuel injection device which directly injects fuel into the cylinder; and an ignition device which ignites a fuel-air mixture in the cylinder. A geometric compression ratio of the cylinder is set to 12 or more. An intake valve closing timing at an engine start time is set to a retarded angle side than an intake bottom dead center, is set to an advanced angle side than a predetermined first reference timing, and is set to the retarded angle side than a second reference timing. The first reference timing is set to a timing corresponding to a most retarded angle position out of intake valve closing timings capable of starting the engine in combusting fuel of 100% alcohol in the cylinder at a predetermined first intake temperature. The second reference timing is set to a timing corresponding to a most advanced angle position out of intake valve closing timings capable of avoiding pre-ignition in combusting fuel of 100% gasoline in the cylinder at an engine start time at a second intake temperature higher than the first intake temperature.

According to the engine having the aforementioned configuration, it is possible to secure startability with a simplified configuration without providing an auxiliary fuel tank for storing fuel for engine start, without depending on the alcohol content of fuel to be used, and even in a condition that the intake air (a temperature of air to be drawn into each cylinder) is relatively low and startability is likely to be deteriorated. Further, it is possible to securely avoid pre-ignition even in a condition that the intake temperature is relatively high and pre-ignition is likely to occur.

The first reference timing and the second reference timing may be set closer to the retarded angle side, as the geometric compression ratio is increased.

In the present invention, preferably, the flexible-fuel engine may further include a hydraulically operated intake valve opening and closing timing changing device which changes an intake valve opening and closing timing. The intake valve opening and closing timing changing device may include a locking device which locks the intake valve closing timing to a predetermined timing between the first reference timing and the second reference timing at least when the engine is stopped.

According to the aforementioned configuration, it is possible to securely set the intake valve closing timing at an engine start time to an appropriate timing between the first reference timing and the second reference timing, thereby securing startability. Specifically, when a hydraulic pressure to be supplied to the intake valve opening and closing timing changing device is not secured, it may be difficult to change the intake valve closing timing to a timing between the first reference timing and the second reference timing by the intake valve opening and closing timing changing device. On the other hand, according to the aforementioned configuration, the intake valve closing timing is locked to a timing between the first reference timing and the second reference timing when the engine is stopped. This is advantageous in securely setting the intake valve closing timing to an appropriate timing at an engine start time.

According to the aforementioned configuration, the intake valve closing timing to be locked when the engine is stopped may be set to a timing corresponding to a most retarded angle position in a range capable of changing the intake valve closing timing.

Further, in the present invention, preferably, an intake valve opening start timing at an engine start time may be set in such a manner that an overlap period when an intake valve opening period and an exhaust valve opening period of the cylinder overlap at the engine start time lies in a range of from −5CA° to 5° CA.

According to the aforementioned configuration, it is possible to set the intake valve closing timing at an engine start time to an appropriate timing between the first reference timing and the second reference timing, and to keep combustion stability high by setting an overlap period of the intake valve and the exhaust valve in a range of from −5 CA° to 5° CA as a period capable securing an appropriate amount of intake air at an engine start time and during a low-load operation time following the engine start time such as an idling operation time.

Further, in the present invention, preferably, the first reference timing may be set to a timing corresponding to a most retarded angle position out of intake valve closing timings capable of starting the engine in combusting fuel of alcohol 100% in the cylinder when the engine is cold started.

According to the aforementioned configuration, it is possible to securely start the engine even when the engine is cold started in which it is difficult to start the engine.

Further, in the present invention, preferably, the second reference timing may be set to a timing corresponding to a most advanced angle position out of intake valve closing timings capable of avoiding pre-ignition in combusting fuel of gasoline 100% in the cylinder when the engine is hot started.

According to the aforementioned configuration, it is possible to securely avoid pre-ignition even when the engine is hot started in which pre-ignition is likely to occur.

The invention claimed is:

1. A flexible-fuel engine capable of using fuel containing alcohol as fuel to be combusted in a cylinder, comprising:

a fuel injection device which directly injects fuel into the cylinder; and an ignition device which ignites a fuel-air mixture in the cylinder, wherein a geometric compression ratio of the cylinder is set to 12 or more, the engine is started by using the fuel containing alcohol at an engine start time, an intake valve closing timing at the engine start time is set to a retarded angle side than an intake bottom dead center, is set to an advanced angle side than a predetermined first reference timing, and is set to the retarded angle side than a second reference timing, the first reference timing is set to a timing corresponding to a most retarded angle position out of intake valve closing timings capable of starting the engine in combusting fuel of 100% alcohol in the cylinder at a predetermined first intake temperature, and the second reference timing is set to a timing corresponding to a most advanced angle position out of intake valve closing timings capable of avoiding pre-ignition in combusting fuel of 100% gasoline in the cylinder at an engine start time at a second intake temperature higher than the first intake temperature.

2. The flexible-fuel engine according to claim 1, wherein the first reference timing and the second reference timing are set closer to the retarded angle side, as the geometric compression ratio is increased.

3. The flexible-fuel engine according to claim 1, further comprising:

a hydraulically operated intake valve opening and closing timing changing device which changes an intake valve opening and closing timing, wherein the intake valve opening and closing timing changing device includes a locking device which locks the intake valve closing timing to a predetermined timing between the first reference timing and the second reference timing at least when the engine is stopped.

4. The flexible-fuel engine according to claim 3, wherein the intake valve closing timing to be locked when the engine is stopped is set to a timing corresponding to a most retarded angle position in a range capable of changing the intake valve closing timing.

5. The flexible-fuel engine according to claim 1, wherein an intake valve opening start timing at an engine start time is set in such a manner that an overlap period when an intake valve opening period and an exhaust valve opening period of the cylinder overlap at the engine start time lies in a range of from −5 CA° to 5° CA.

6. The flexible-fuel engine according to claim 1, wherein the first reference timing is set to a timing corresponding to a most retarded angle position out of intake valve closing timings capable of starting the engine in combusting fuel of alcohol 100% in the cylinder when the engine is cold started.

7. The flexible-fuel engine according to claim 1, wherein the second reference timing is set to a timing corresponding to a most advanced angle position out of intake valve closing timings capable of avoiding pre-ignition in combusting fuel of gasoline 100% in the cylinder when the engine is hot started.

* * * * *